US006283414B1

(12) United States Patent
Quinones et al.

(10) Patent No.: US 6,283,414 B1
(45) Date of Patent: Sep. 4, 2001

(54) ILLUMINATED KITE

(76) Inventors: William Quinones, 1174 SW. 118th Ter., Davie, FL (US) 33325; Edward Joseph Wollick, 4897 SW. 26th Ave., Dania, FL (US) 33312

( * ) Notice: Subject to any disclaimer, the term of this patent is extended or adjusted under 35 U.S.C. 154(b) by 0 days.

(21) Appl. No.: 09/410,537

(22) Filed: Oct. 1, 1999

(51) Int. Cl.[7] ..... A63H 27/08; B64C 31/06; F41J 9/08; F21V 33/00

(52) U.S. Cl. ..... 244/155 R; 244/153 R; 362/253; 362/806

(58) Field of Search ..... 244/153 A, 155 A, 244/155 R, 154, 153 R; 362/253, 806

(56) References Cited

U.S. PATENT DOCUMENTS

| | | | | |
|---|---|---|---|---|
| D. 392,345 | * | 3/1998 | Burghardt | D21/88 |
| 4,715,564 | * | 12/1987 | Kinn et al. | 244/153 R |
| 4,942,506 | * | 7/1990 | Flory | 362/253 |
| 5,000,402 | * | 3/1991 | Blackburn | 244/153 R |
| 5,018,056 | * | 5/1991 | Hou | 362/253 |
| 5,098,039 | | 3/1992 | Linden, Jr. | 244/153 R |
| 5,528,476 | * | 6/1996 | Fenton | 362/249 |
| 5,856,029 | | 1/1999 | Burrows | 428/690 |
| 5,856,030 | | 1/1999 | Burrows | 428/690 |
| 5,860,731 | * | 1/1999 | Martinez | 362/252 |
| 5,893,628 | * | 4/1999 | Byers | 362/252 |
| 5,924,793 | | 6/1999 | Pahl et al. | 362/581 |
| 6,052,164 | * | 4/2000 | Cobb, Jr. et al. | 349/64 |
| 6,168,115 | * | 1/2001 | Abdelkhaleq | 244/155 R |

OTHER PUBLICATIONS

Maxwell Eden, The Magnificant Book of Kites, New York: Black Dog and Leventhal Publishers, 1998, pp. 18–19, 90–100.

Ken Burrows, Let There Be Light: Screen Printing EL Lamps for Membrane Switches, Screen Printing, Jan., 1999, pp. 30–36.

* cited by examiner

*Primary Examiner*—Charles T. Jordan
*Assistant Examiner*—Christian M. Best
(74) *Attorney, Agent, or Firm*—Ronald V. Davidge

(57) ABSTRACT

An illuminated kite includes a number of light sources extending along its surfaces. These light sources may include a number of light circuits, each of which includes light bulbs extending in a spaced-apart relationship along an electrical wire including a pair of conductors, or one or more electroluminescent panels extending along a cover surface of the kite. The light circuits extend, within transparent sleeves formed in the kite cover, adjacent structural members of the kite. The electroluminescent panels are coated on the surface of the kite cover, or they are formed as elastomeric solids to be placed in pockets on the kite cover.

32 Claims, 7 Drawing Sheets

FIG. 9
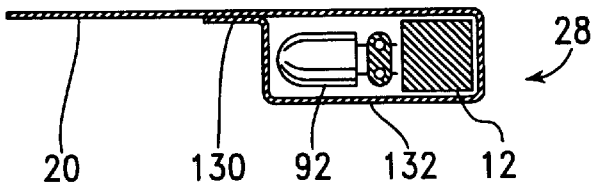
FIG. 10
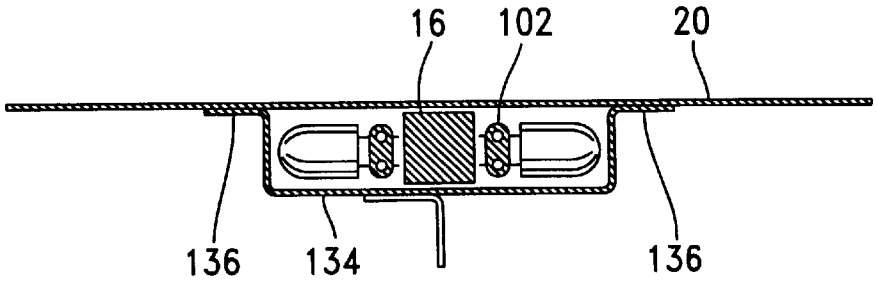
FIG. 11
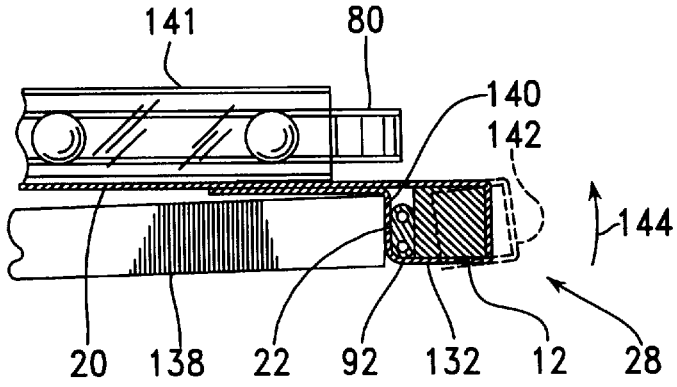
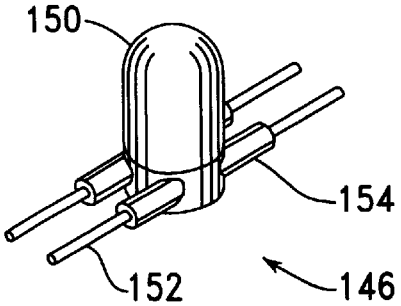
FIG. 12
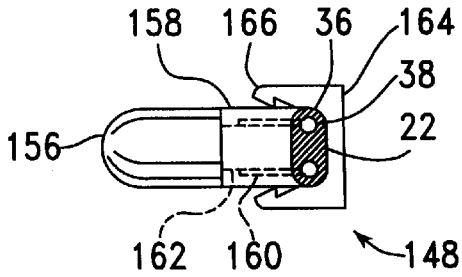
FIG. 13

ILLUMINATED KITE

BACKGROUND OF THE INVENTION

1. Field of the Invention

This invention relates to kites, and, more particularly, to kites which are illuminated so that they can be seen when they are flown at night.

2. Background Information

While kites of may descriptions have been known for a long time, with various aerodynamic features, various structural features, and various types of decorations, relatively few ways to illuminate a kite for night flying are discussed in the patent art.

U.S. Pat. No. 5,098,039 to Linden, Jr. describes a kite, designed for night flying, having a facial ornamental design. The kite includes a frame means for providing the structural support of the kite, with the frame means including a plurality of frame members being in mechanical association with one another. A body means provides the aerodynamic flight characteristics of the kite, with the body means being supported by the frame means. The body means includes an interchangeable face means, the interchangeable face means allowing the selective substitution of a variety of ornamental designs for the kite. The kite includes an illumination means for illuminating the ornamental designs of the kite, with the illumination means also being supported by the frame means. The illumination means includes a single light bulb in front of a semi-spherical reflector, which is spaced behind the ornamental design, being supported by a framework extending along the rear of the kite. The ornamental design is partly translucent, with colored panels, and partly opaque, so that the ornamental design is clearly seen at night when illuminated from behind.

U.S. Pat. No. 5,924,793 to Pahl, et al. describes a light illumination frame comprising compact battery powered apparatus with a single light source that illuminates an optical medium in the form of an elongated tubular-shaped semitransparent material. This material may be applied to the exterior of an object, or the material may be shaped to form a support structure of an object. The light source is contained within a light chamber in the fixture. A slidable cover together with a battery actuation contact means forms a switch to actuate the light source. A plurality of openings extending from the light chamber receive the light-transmitting elongated tubular-shaped semitransparent material. The light illumination fixture, together with the tubular light transmitting material can be used to illuminate an object such as a kite. In this application, the tubular shaped transparent material extends in four directions from a centrally located light illumination fixture, forming structural members along which the cover sheet of the kite is stretched.

Both of these examples from the patent art use a single light source to illuminate a particular structure, with the apparatus of U.S. Pat. No. 5,098,039 illuminating the ornamental design of an interchangeable face, while the apparatus of U.S. Pat. No. 5,924,793 illuminates a number of elongated tubes extending outward from a central light illumination fixture. What is needed is a structure deploying a number of small lights of various colors along the surface of a kite. Furthermore, what is needed is a structure providing for a number of lights to be directly visible from each side of the kite, with the kite cover being composed of a transparent material, so that the output of the light sources appears as a bright pattern of light.

U.S. Pat. No. 5,856,029 to Burrows describes an electroluminescent system in which neighboring layers are suspended, prior to application, in advantageously a unitary carrier compound, so that after curing, the layers form active strata within a monolithic mass. The carrier compound in a preferred embodiment is a vinyl resin in gel form. This invention enables several manufacturing advantages, including the ability to silk-screen print the entire electroluminescent system on a variety of substrates, including cloth, metals, plastics, wood, or even stone.

U.S. Pat. No. 5,856,030 to Burrows describes an elastomeric electroluminescent (EL) lamp, in which an electroluminescent system, advantageously monolithic, is provided in an elastomeric structure. As a result, the lamp is thin, pliable, and membrane-like. A first envelope layer is applied advantageously by screen printing to transfer release paper. An EL system is then applied, again advantageously by screen printing, to the first envelope layer, and then a second envelope layer is applied to seal the EL system within the envelope. Appropriate windows are cut or left open to allow electrical contact with the EL system. An optional adhesive layer then may be applied if the lamp is to be used in transfer form for later affixation to a substrate. Alternatively, the lamp may be used as a self-contained elastomeric component installed in another product.

What is needed is a kite including electroluminescent structures made, for example, according to the teachings of U.S. Pat. Nos. 5,856,029and -030, attached to the cover of the kite to provide illuminated patterns when the kite is being flown at night.

SUMMARY OF THE INVENTION

According to a first aspect of the present invention, there is provided an illuminated kite including a frame, a transparent cover sheet, a number of light sources, and a battery power source. The frame includes a number of structural members providing structural support. The transparent cover sheet is attached to various of these structural members, being stretched between them to provide for aerodynamic flight. The number of light sources extends along the transparent cover sheet, within each of the light sources being directly visible from each side of the transparent cover sheet. The battery power source is electrically connected to the number of light sources.

The number of light sources may include a first light circuit extending within a first transparent sleeve extending along the transparent cover sheet. This first light circuit includes conductive wires electrically connected to the battery power source and a number of light bulbs extending within the first transparent sleeve.

The number of light sources may additionally or alternatively include an electroluminescent panel extending along a first side of the transparent cover sheet.

According to another aspect of the current invention, there is provided an illuminated kite including a frame, a cover sheet, an electroluminescent panel, and an alternating current power source. The frame includes a number of structural members providing structural support. The cover sheet is attached to various of these structural members, being stretched among them to provide for aerodynamic flight. The electroluminescent panel extends along a first side of the cover sheet. The alternating current power source has first and second output terminals electrically driving the electroluminescent panel.

BRIEF DESCRIPTION OF THE DRAWINGS

FIG. 9 is a fragmentary oblique cross-sectional view, taken as indicated by section lines III—III in FIG. 1 to show the attachment of an edge support member and of a light circuit to a cover sheet in a second embodiment of an illuminated kite built in accordance with the present invention;

FIG. 10 is a fragmentary longitudinal cross-sectional view, taken as indicated by section lines IV—IV in FIG. 1 to show the attachment of one or more light circuits to the cover sheet of the second embodiment of the illuminated kite of FIG. 9;

FIG. 11 is a fragmentary oblique cross-sectional view, taken as indicated by section lines VI—VI in FIG. 1 to show the engagement of transverse support member with the edge support member of the second embodiment of the illuminated kite of FIG. 9;

FIG. 12 is a fragmentary perspective view of a first alternative light circuit for use in the illuminated kite of FIG. 1;

FIG. 13 is a fragmentary transverse cross-sectional view of a second alternative light circuit for use in the illuminated kite of FIG. 1;

DETAILED DESCRIPTION

Figure 1:
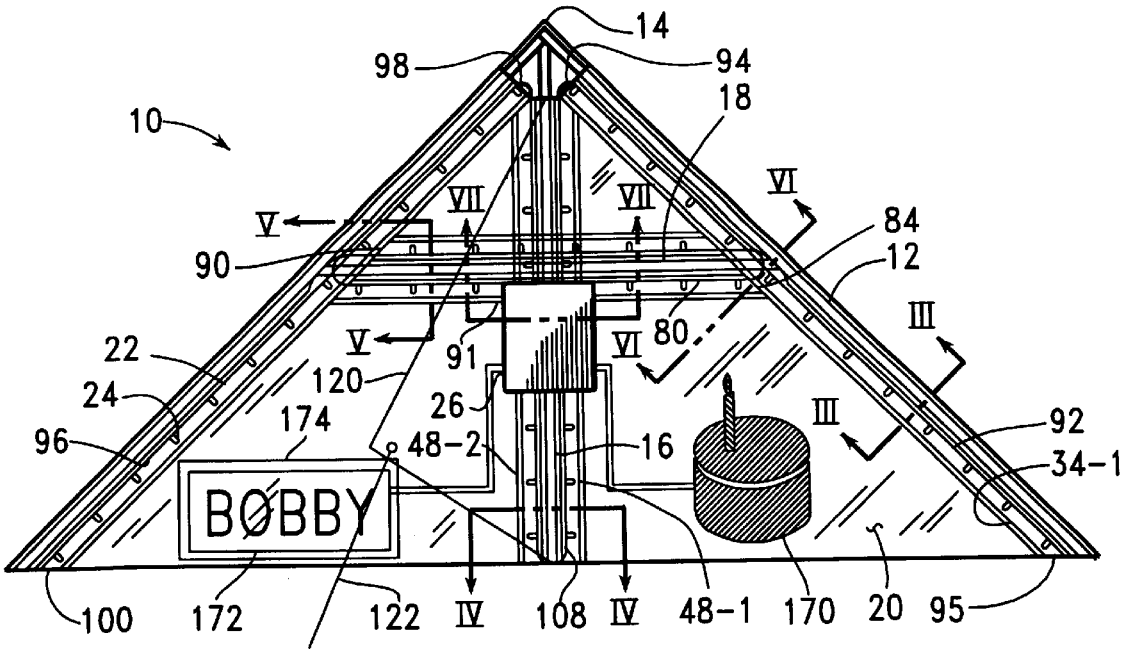
FIG. 1 is a plan view of an illuminated delta kite built in accordance with the present invention.
Figure 2:
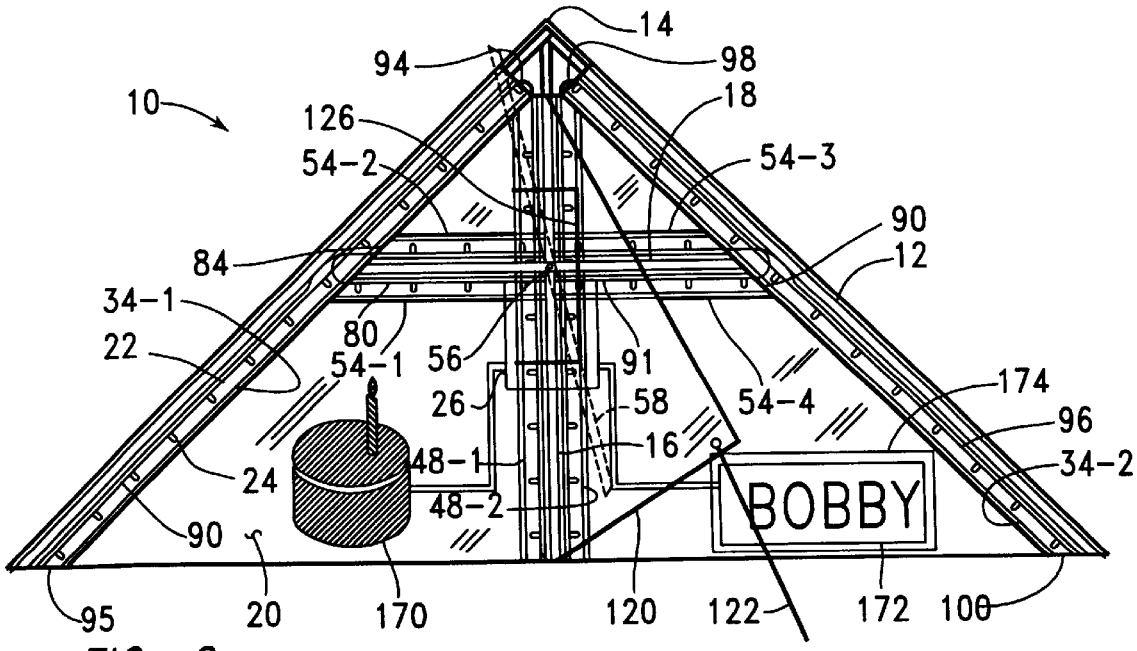
FIG. 2 is an underneath plan view of the illuminated kite of FIG. 1.

FIGS. 1 and 2 show an illuminated kite, generally indicated as 10, built in accordance with the present invention, with FIG. 1 being a plan view of the kite 10, and with FIG. 2 being an underneath plan view thereof. The structure of the kite 10 is supported by a pair of edge support members 12, extending obliquely from a front point 14, a longitudinal support member 16, extending centrally from the front point 14, and a transverse support member 18, extending within the kite structure between the edge support members 12. The cover sheet 20 of the kite, which is preferably a thin flexible sheet of a transparent plastic material, such as polyvinyl chloride (PVC) or the polyester material sold by DuPont under the trademark MYLAR, is stretched between the edge support members 12 and across the longitudinal support member 16. The illuminated kite 10 also includes a number of electrical lines 22 with small light bulbs 24 attached thereto. Each separate electrical line 22 is electrically connected to a battery power source 26. The individual light bulbs 24 are preferably tinted with various colors, and some, or all, of the individual light bulbs 24 may be arranged to flash. Because of the transparency of the material composing the cover sheet 20, most of the light bulbs 24 may be seen regardless of the orientation of the kite 10 as it is flown at night.

Figure 3:
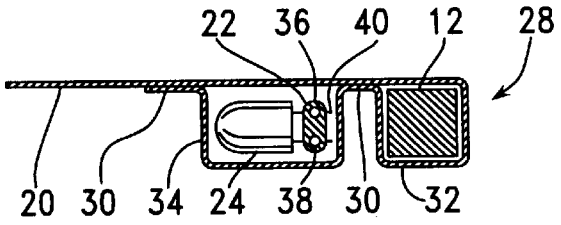
FIG. 3 is a fragmentary oblique cross-sectional view, taken as indicated by section lines III—III in FIG. 1 to show the attachment of an edge support member and of a light circuit to a cover sheet of the illuminated kite of FIG. 1.

FIG. 3 is a fragmentary oblique cross-sectional view, taken as indicated by section lines III—III in FIG. 1 to show the attachment of the edge support member 12 to the cover sheet 20 of the illuminated kite 10. The obliquely extending peripheral portion 28 of the cover sheet 20 is folded and joined at lap joints 30 to form an outer sleeve 32 and an inner sleeve 34. The lap joints 30 may be formed using one of a number of well-known methods for joining similar plastic sheets having lapped surfaces. Such methods include adhesive bonding, chemical bonding, ultrasonic bonding, heat sealing, and sewing with thread. The edge support member 12 is slid into the outer sleeve 32. An electrical line 22 with attached light bulbs 26 is slid into the inner sleeve 34. A number of ways for forming such joints are discussed in *The Magnificent Book of Kites,* by Maxwell Eden, New York: Black Dog and Leventhal Publishers, Inc., 1998, pp. 90–100.

While the electrical lines 22 may be formed in many ways, including the use of separate insulated wires twisted together and extending in a manner providing both mechanical support and electrical power for the individual light bulbs 24, the figures show an exemplary construction in which an insulating layer 36 is extruded over a pair of stranded conductors 38. Each bulb includes a pair of outward-extending leads 40, each of which is connected to a stranded connector 38 by means of a mechanical connection or by means of soldering.

Figure 4:
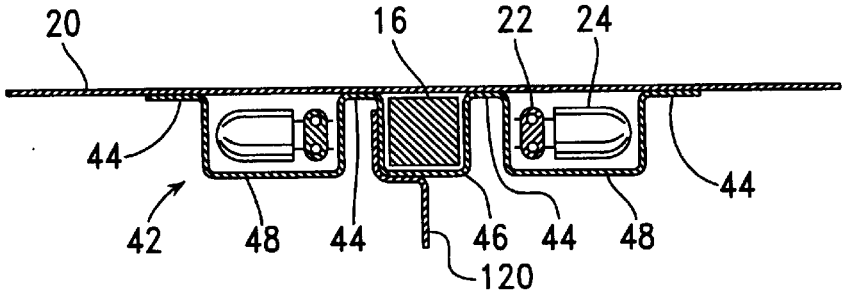
FIG. 4 is a fragmentary transverse cross-sectional view, taken as indicated by section lines IV—IV in FIG. 1 to show the attachment of a longitudinal support member and of a pair of light circuits to the cover sheet of the illuminated kite of FIG. 1.

FIG. 4 is a fragmentary transverse cross-sectional view, taken as indicated by section lines IV—IV in FIG. 1 to show the attachment of the longitudinal support member 16 to the cover sheet 20 of the illuminated kite 10. A separate longitudinally-extending strip 42, preferably composed of the same material as cover sheet 20, is connected to the cover sheet 20 by means of lap joints 44, which are preferably constructed in the manner of the lap joints 30 described above in reference to FIG. 3. This process provides a central sleeve 46, into which the longitudinal support member 16 is slid, and a pair of outer sleeves 48, into which a pair of electrical lines 22 with attached light bulbs 24 are slid.

Figure 5:
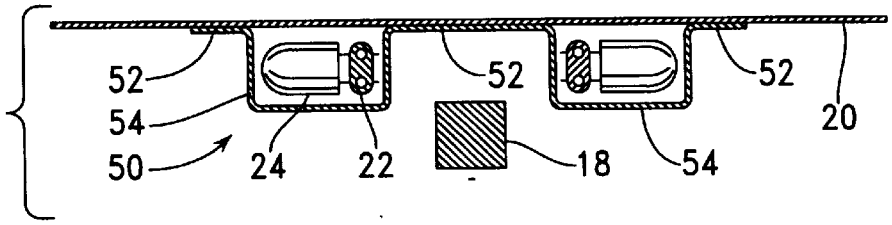
FIG. 5 is a fragmentary longitudinal cross-sectional view, taken as indicated by section lines V—V in FIG. 1 to show the attachment of a pair of light circuits to the cover sheet of the illuminated kite of FIG. 1.

FIG. 5 is a fragmentary longitudinal cross-sectional view, taken as indicated by section lines V—V in FIG. 1 to show the attachment of a pair of electrical lines 22 with attached light bulbs 24, extending adjacent the transverse support member 18 to the cover sheet 20. A separate transversely-extending strip 50, also preferably composed of the same material as the cover sheet 20, is connected to the cover sheet 20 by means of a lap joints 52, providing a pair of sleeves 54 through which the electrical lines 22 are slid.

Figure 6:
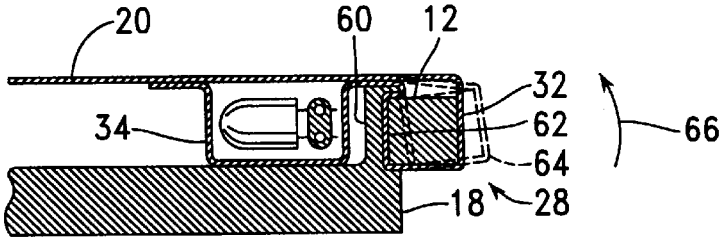
FIG. 6 is a fragmentary oblique cross-sectional view, taken as indicated by section lines VI—VI in FIG. 1 to show the engagement of a transverse support member with the edge support member in the illuminated kite of FIG. 1.

FIG. 6 is a fragmentary oblique cross-sectional view, taken as indicated by section lines VI—VI in FIG. 1 to show the engagement of the transverse support member 18 with the edge support member 12 in the illuminated kite of FIG. 1.

Referring to FIGS. 2 and 6, the transverse support member 18 is centrally pivoted at a pin 56 extending downward from the longitudinal support member 16, allowing the kite 10 to be folded for storage and shipment with the transverse support member 18 pivoted into the alternate position indicated by dashed lines 58. The transverse support member 18 is provided at each end with an upstanding tab 60 including a channel 62 for engaging the adjacent edge support member 12 extending within the outer sleeve 32. This upstanding tab 60 extends upward between the outer sleeve 32 and the inner sleeve 34.

Before the illuminated kite 10 is folded, obliquely-extending peripheral portion 28 of the kite 10 is pulled outward, until the outer sleeve 32 and the edge support member 12 are in the position indicated by dashed lines 64. The peripheral portion 28 is then folded upward, in the direction of arrow 66. When the outer sleeve 32 and the inner sleeve 34 have been moved to clear the upward extending tabs 60 at each end of the transverse support member 18, the transverse support member 18 is pivoted into the position indicated by dashed lines 58, and the kite 10 is folded as desired for storage or shipment. The kite 10 is subsequently unfolded and restored to a flying configuration by repeating this process in a reverse order.

Figure 7:
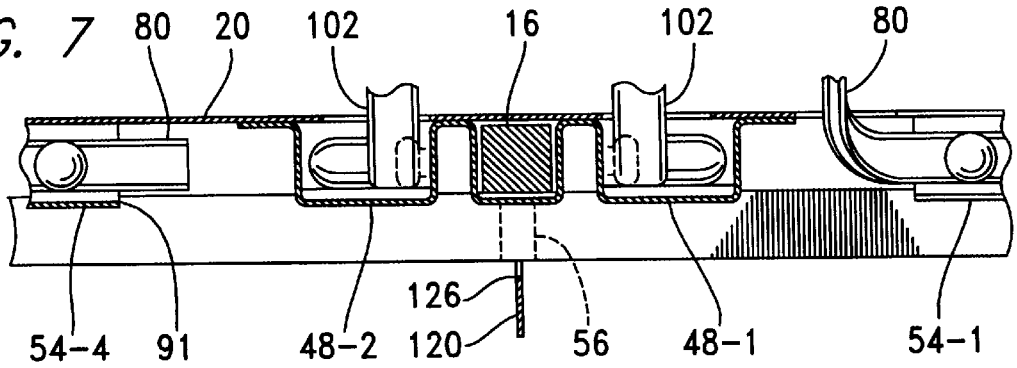
FIG. 7 is a fragmentary transverse cross-sectional view, taken as indicated by section lines VII—VII in FIG. 1 to show how wires for lighting circuits are fed into sleeves within the illuminated kite of FIG. 1.

FIG. 7 is a fragmentary transverse cross-sectional view, taken as indicated by section lines VII—VII in FIG. 1 to show how wires for lighting circuits are fed into sleeves 48, 54 within the illuminated kite 10.

Figure 8:
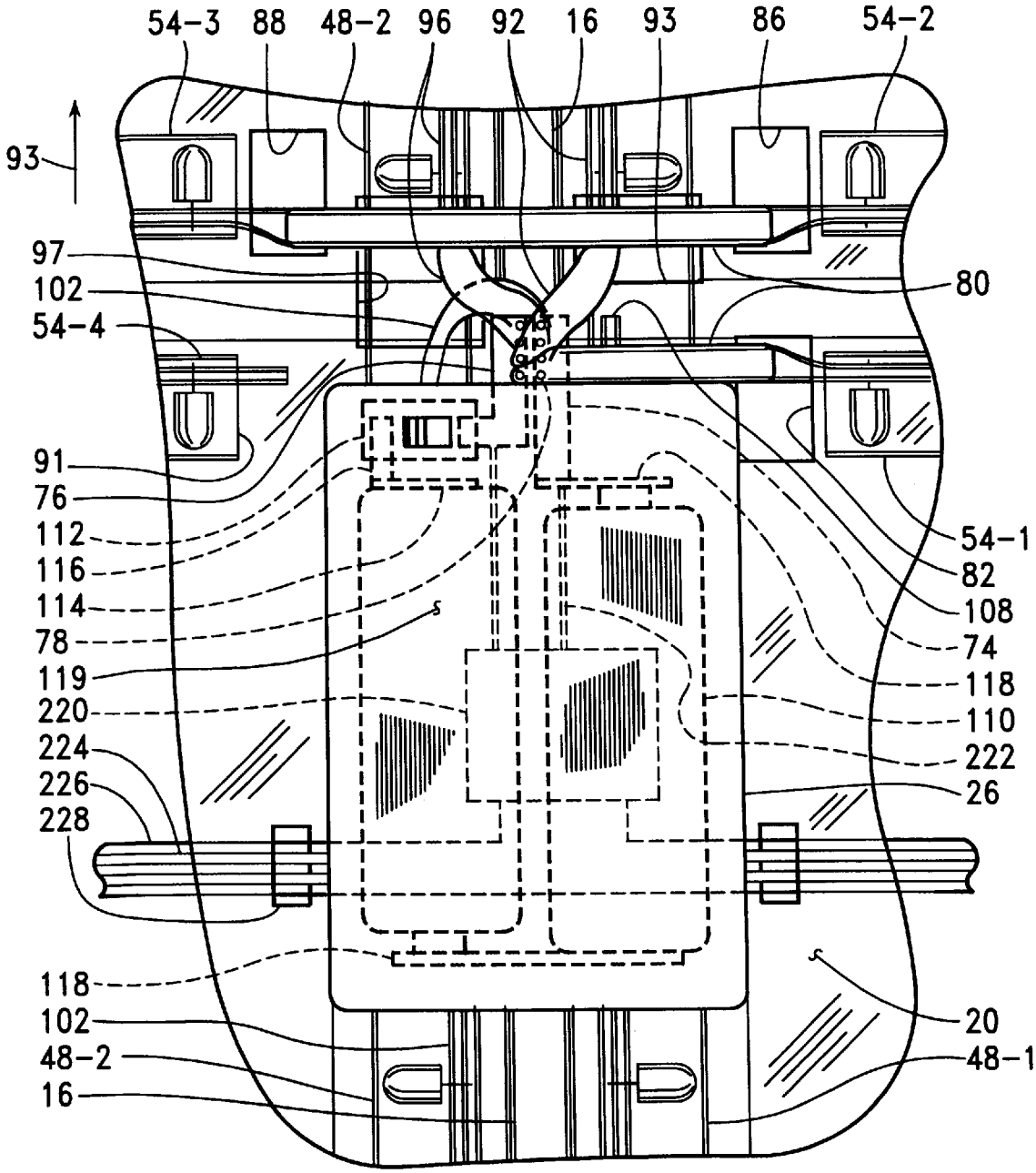
FIG. 8 is a fragmentary plan view of the illuminated kite of FIG. 1, showing electrical connections to a battery box therein.

FIG. 8 is a fragmentary plan view of the illuminated kite 10, particularly showing the battery power source 26, with its connections to wires for lighting circuits.

Referring to FIGS. 1, 7, and 8, the various electrical lines 22, extending through sleeves 48, 54 under the kite cover 20 are brought upward through a number of apertures in the kite cover 20 for connection to output terminals 74, 76 of a battery box 26 serving as a power source. Each of these output terminals 74, 76 includes a number of holes 78 into which the conductors 38 (shown in FIG. 3) of the electrical lines 22 are soldered. Each electrical line 22 includes one conductor 38 soldered into the right output terminal 74 and the other conductor 38 soldered into the left output terminal 76.

In accordance with a preferred wiring configuration, a first lighting circuit 80, composed of a wire 22 and a number of light bulbs 24, extends through all four transversely extending sleeves 54, with the circuit 80 extending downward through an aperture 82 into a first sleeve 54-1, and with the circuit 80 being curved at an outer end 84 of the first sleeve 54-1 to extend through the second sleeve 54-2. Next, the lighting circuit 80 extends upward through an aperture 86 above the kite cover 20 to cross over the longitudinal support member 16, and downward through an aperture 88 into the third sleeve 54-3. Then the circuit 80 is curved at an outer end 90 of the third sleeve 54-3 to extend back into the fourth sleeve 54-4. The lighting circuit 80 is terminated at the inner end 91 of the fourth sleeve 55-4. Furthermore, a second lighting circuit 92 extends downward through an aperture 91 and through the right longitudinally-extending sleeve 48-1 in the forward direction of arrow 93 to be curved at a front end 94 of this sleeve into a right obliquely-extending sleeve 34-1. This second lighting circuit 92 extends within the sleeve 34-1 to end near the rear end 95 of the sleeve 34-1. Similarly, a third lighting circuit 96 extends downward through an aperture 97 and through the left longitudinally-extending sleeve 48-2 in the forward direction of arrow 93 to be curved at a front end 98 of this sleeve into a left obliquely-extending sleeve 34-2. This third lighting circuit 96 extends within the sleeve 34-2 to end near the rear end 100 of the sleeve 34-2. Also, a fourth lighting circuit 102 through the aperture 97 and rearward, opposite the direction of arrow 93, within the left longitudinally-extending sleeve 48-2 to be curved at a rear end 104 of this sleeve 48-2 into the right longitudinally-extending sleeve 48-1. The fourth lighting circuit 102 extends within the sleeve 48-1 to an end 108 of the lighting circuit 102.

The battery box 26 includes a pair of AA cells 110, which are connected in series with the output terminals 74, 76 and with a slider switch 112. A spring tab 114 of a terminal 116 attached to the switch 112, a spring plate 118, and a spring tab 118 of the right output terminal 74 maintain mechanical contact within the circuit including the AA cells 110. When the switch 112 is turned on, a potential of about three volts is established between the conductors 38 (shown in FIG. 3) of each electrical line 22 to drive the light bulbs 24. An outer cover 119 of the battery box 26 is preferably removable and replaceable to facilitate the replacement of the AA cells 110. The cover 119 is held in place with conventional flexible latches with a screw, in a manner familiar to those skilled in the art of portable electrical devices.

Referring to FIGS. 1, 2, 4, and 7, vertical surfaces are provided to enhance the stability of the illuminated kite 10 in flight through the use of a flexible keel 120 attached to extend downward along the longitudinal center of the kite 10. The flexible keel 120 is shown folded against the kite cover 20 in FIGS. 1 and 2 and fully extended downward in FIGS. 4 and 7. A string 122 is tied to the keel 120 near its outer corner 124 for holding the kite in flight from the ground. In flight, wind pushing on the kite cover 20 maintains the flexible keel in its fully extended position. The flexible keel 120 is attached to extend along the central sleeve 46, with, for example, one of the various attachment means described for lap joints 30, 44 being used. A slot 126 is provided in the flexible keel 120 to allow the passage therethrough of the transverse support member 18 and its rotation into the position indicated by dashed lines 58.

The above-described configuration of light circuits provides light circuits extending adjacent both sides of the longitudinal support member 16, adjacent both sides of the transverse support member 18, and adjacent an inner side of each edge support member 12. This configuration of light circuits is readily varied to produce different and striking configurations of illumination. For example, if light circuits are arranged to extend only along both sides of the longitudinal support member 16 and along the inner sides of the edge support members 12, an illuminated arrow is formed. In another version of the present invention, light circuits are arranged to extend only along both sides of the longitudinal support member 16 and the transverse support member 18, an illuminated cross is formed.

FIGS. 9–11 are fragmentary cross sectional views of a second embodiment of an illuminated kite built in accordance with the present invention, with elements similar to those previously described relative to the first embodiment being afforded like reference numerals.

FIG. 9 is taken as indicated by section lines III—III in FIG. 1 to show the attachment of the edge support member 12 to the cover sheet 20 of the second embodiment. The obliquely extending peripheral portion 28 of the cover sheet 20 is folded and joined at a lap joint 130, so that a sleeve 132 extends around both the edge support member 12 and the adjacently extending light circuit 92.

FIG. 10 is a fragmentary longitudinal cross-sectional view, taken as indicated by section lines IV—IV in FIG. 1 to show the attachment of one or more light circuits to the cover sheet 20 of the second embodiment of the illuminated kite of FIG. 9. A single transparent sleeve 134 is fastened to the cover sheet 20 at lap joints 136, enclosing both light circuit(s) 102 and the longitudinal support member 16.

FIG. 11 is a fragmentary oblique cross-sectional view, taken as indicated by section lines VI—VI in FIG. 1 to show the engagement of transverse support member with the edge support member of the second embodiment of the illuminated kite of FIG. 9. As in the first embodiment, the transverse support member 138 of the second embodiment is centrally pivoted at a pin extending downward from the longitudinal support member 16, with the transverse support member 138 extending below the longitudinal support member 16, allowing the kite to be folded for storage and shipment with the transverse support member 138 pivoted into an alternate position. However, at each end 140, the transverse support member 138 is disposed adjacent the edge support member 12, with an electrical line 22 of the light circuit 92 extending within the compressed sleeve 132 between the end 140 and the edge support member 12. The electrical lights on this light circuit 92 are spaced along the line 22 so that they are absent from the location into which the transverse support member 138 swings. In order to remain clear of the transverse support member 138, the lighting circuit 80 providing lights extending along each side of the transverse support member 138 preferably extend within a pair of transparent sleeves 141, which in turn extend along each side of the transverse support member 138 but on an opposite side of the cover sheet 20 from the transverse support member 138.

Before the second embodiment of the illuminated kite is folded, obliquely-extending peripheral portion 28 of the kite 10 is pulled outward, until the outer sleeve 132 and the edge support member 12 are in the position indicated by dashed lines 142. The peripheral portion 28 is then folded upward, in the direction of arrow 144. The transverse support member 138 is then pivoted into the position indicated by dashed lines 58 (shown in FIG. 1), and the kite is folded as desired for storage or shipment. The kite is subsequently unfolded and restored to a flying configuration by repeating this process in a reverse order.

FIGS. 12 and 13 show alternative constructions of the light circuits, with FIG. 12 being an isometric view of a first alternative lighting circuit 146, and with FIG. 12 being a fragmentary transverse cross-sectional view of a second alternative lighting circuit 148.

Referring first to FIG. 12, in the first alternative lighting circuit 146, leads from a small light bulb 150 are soldered to conductors within a pair of insulated single-conductor lines 152. Following the soldering process, the exposed conductive surfaces are covered with an insulating compound forming an insulating structure 154. The lines 152 may be twisted together or otherwise tied together between lamps 150 to simplify handling and to present a neater appearance.

Referring to FIG. 13, in the second alternative lighting circuit 148, a light bulbs 156 is plugged into a socket 158 having terminals 160, which pierce and displace adjacent portions of the insulating layer 36 of a circuit line 22 having two conductors 38, to contact the individual conductors 38. The terminals 160 also contact leads 162 extending from the lamp 156, so that these leads 162 are connected to the respective conductors 38. A cap 164 snaps over the socket 158, being held in place by a pair of latches 166 to hold the socket 158 in place on the circuit line 22.

It is further understood that the various light sources described above may be light emitting diodes (LEDS), spaced apart along electrical wires providing them with suitable electrical current, within the scope of the present invention.

Referring again to FIGS. 1 and 2, in accordance with a preferred version of the present invention, the illuminated kite 10 includes, in addition to the light circuits described above, which provide light from an number of small light surfaces, one or more electroluminescent panels. In the example of FIGS. 1 and 2, the illuminated kite 10 includes a first electroluminescent panel 170, coated onto the surface of the transparent cover 20 and a second electroluminescent panel 172, held within a transparent pocket 174 attached to the surface of the transparent cover 20.

Figure 14:
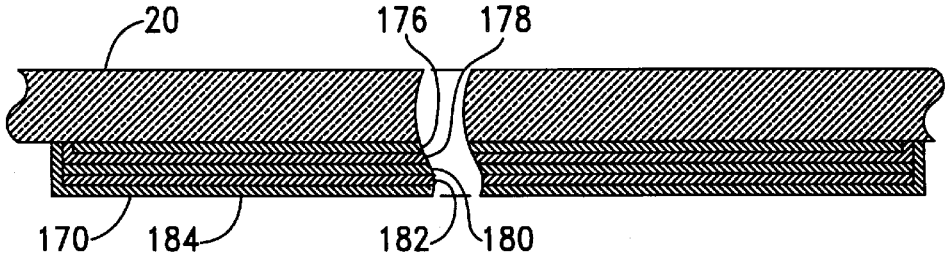
FIG. 14 is a fragmentary cross-sectional view of an electroluminescent panel coated on a transparent kite cover, in the illuminated kite of FIG. 1, to project light from both sides of the cover.

FIG. 14 is a fragmentary cross-sectional view of the first electroluminescent panel 170. This panel 170 includes a first translucent electrode layer 176, a dielectric layer 178, a luminescent layer 180, and a second translucent electrode layer 182. This panel 170 may also include a cover layer 184. To provide light by electroluminescence, the electroluminescent panel 170 operates as a "lossy" parallel plate capacitor of layered construction. The luminescent layer 180 is energized as alternating current flows, through capacitive coupling, between the first translucent electrode layer 176 and the second translucent electrode layer 182. While a typical electroluminescent panel is driven with about 115 volts of alternating current at about 400 Hz, electroluminescent panels are known to operate using voltage levels between 60 and 500 volts and frequencies between 60 Hz and 2.5 KHz. The luminescent layer 180 may contain a number of different types of phosphorous, and may be further varied through the use of dyes to obtain a particular color of emitted light. The luminescent layer 180 may include a number of separate sections emitting different colors of light, such as the layers representing a birthday cake, candle, and flame in the example of FIGS. 1 and 2.

The dielectric layer 178 has been described as being between the first translucent electrode layer 176 and the luminescent layer 180. It is understood that, while the luminescent layer 180 and the dielectric layer 178 must be placed together between the translucent electrode layers 176, 182 this order of placement is not required; the dielectric layer 178 may alternately be placed between the luminescent layer 180 and the second translucent electrode layer 182.

U.S. Pat. No. 5,856,029 describes an electroluminescent panel which may be silk-screen printed on a variety of substrates, including plastics. This type of panel may be used to form the electroluminescent panel 170, with an important difference being that both of the electrode layers 176, 182 must be translucent so that light is emitted from both sides of the panel 170. Conventional electroluminescent panels are made with translucent electrode layers composed of polyester film which has been sputter coated with indium tin oxide (ITO). Since polyester film is also a suitable material for kite covers, the transparent kite cover 20 may be coated in this way to form the first translucent electrode. A bus bar, formed by printing a single layer of a material containing, for example, silver, is coated around the area in which the electroluminescent image is to be formed, so that a maximum level of current may be applied to this area. Then the luminescent layer is coated.

When light is emitted from both sides of an electroluminescent panel in this way, the images of the panel from opposite sides of the kite 10 are mirror images of one another. For many objects being depicted, such as the birthday cake, candle, and flame of the panel 170, this is not a problem.

Figure 15:
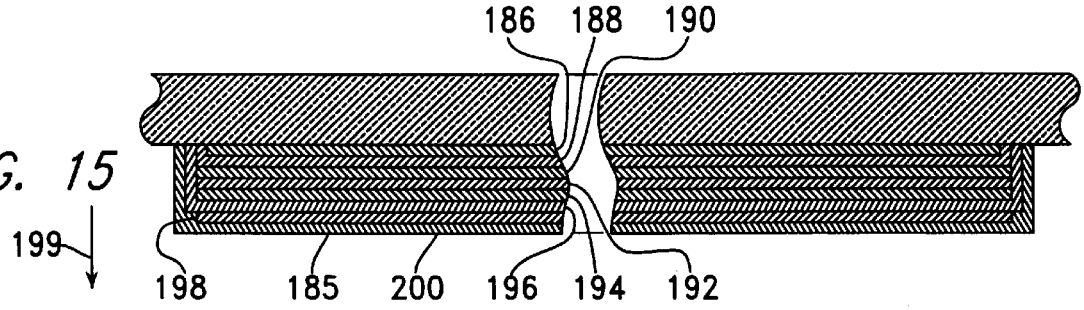
FIG. 15 is a fragmentary cross-sectional view of an electroluminescent panel coated on a transparent kite cover, in the illuminated kite of FIG. 1, to project light from in differing images from both sides of the cover.

FIG. 15 is a fragmentary cross-sectional view of a double electroluminescent panel 105, which is used to display text and other images which should only be viewed from a particular side. This panel includes a first translucent electrode layer 186, a first luminescent layer 188, a first dielectric layer 190, and an intermediate electrode layer 192 to provide an illuminated image which is transmitted through the transparent kite cover 20. Similarly, the intermediate electrode layer 192 is used with a second luminescent layer 194, with a second dielectric layer 196, and with a second translucent electrode layer 198 to provide an illuminated image which is transmitted away from the transparent kite cover 20, in the direction of arrow 199. This panel 185 may also include a translucent cover layer 200. The intermediate electrode layer 192 is opaque to prevent the transmission of light between the luminescent layers 188, 194, so that separate illuminated images are displayed from the opposite sides of the kite cover 20. Again, this ordering of the luminescent layers and the adjacent dielectric layers is not required, although it is preferred to avoid a requirement that the light from the luminescent layers 188, 194 must shine through the dielectric layers 190, 196. With this arrangement, the first luminescent layer 188 and the second luminescent layer 184 may be configured so that the same image is presented from each side of the kite 10, or, if desired, so that a different image is presented from each side of the kite 10.

Figure 16:
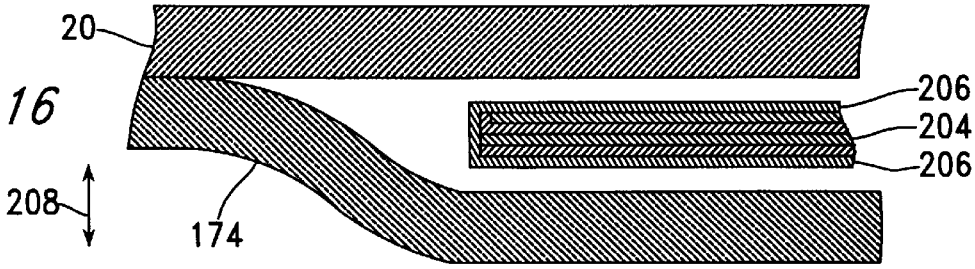
FIG. 16 is a fragmentary cross-sectional view of an electroluminescent panel held in a pocket of a transparent kite cover, in the illuminated kite of FIG. 1, to project light from both sides of the cover.

FIG. 16 is a fragmentary cross-sectional view of an electroluminescent panel 204 provided as a separate structure held within a pocket 174 extending along the surface of the kite cover 20. U.S. Pat. No. 5,856,030 describes an electroluminescent panel which is provided in the form of a, preferably monolithic, elastomeric structure. The concepts described within U.S. Pat. No. 5,856,030 may be used to build the electroluminescent panel 204. The various types of layers described above in reference to FIG. 14 are similarly provided within the electroluminescent panel 204, which may be surrounded by cover layers 206. In a preferred version, this panel 204 emits light in both directions, as indicated by arrow 208.

Figure 17:
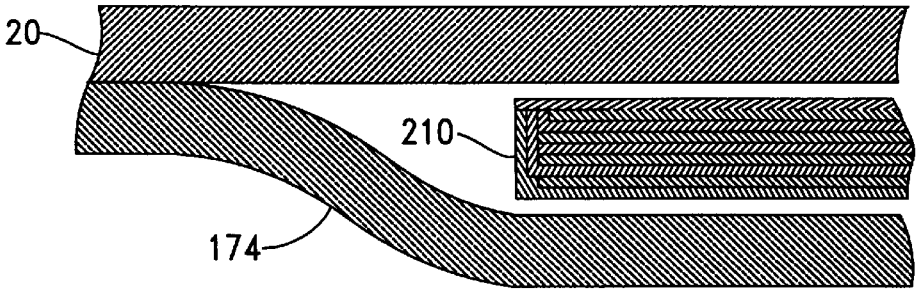
FIG. 17 is a fragmentary cross-sectional view of an electroluminescent panel held in a pocket of a transparent kite cover, in the illuminated kite of FIG. 1, to project light in differing images from both sides of the cover.

FIG. 17 is a fragmentary cross-sectional view of an electroluminescent panel 210 provided as a second type of separate structure held within the pocket 174 extending along the surface of the kite cover 20. The concepts described within U.S. Pat. No. 5,856,030 may again be used to build the electroluminescent panel 210. The various layers described above in reference to FIG. 15. This is the arrangement which is shown within the pocket 174 in FIGS. 1 and 2.

Figure 18:
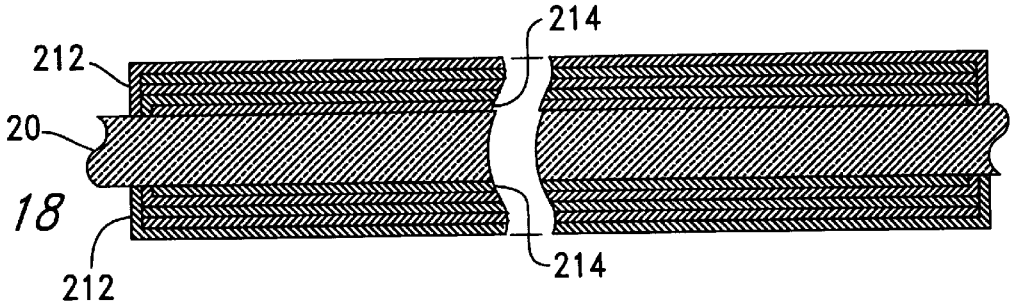
FIG. 18 is a fragmentary cross-sectional view of a pair of electroluminescent panels coated on opposite sides of a kite cover, in the illuminated kite of FIG. 1, to project light in differing images from both sides of the cover.

FIG. 18 is a fragmentary cross-sectional view of pair of electroluminescent panels 212 coated on opposite sides of the kite cover 20. These panels 212 are preferably each configured as described in reference to FIG. 14, except that the electrode layers 214 adjacent the kite cover 20 are preferably opaque.

Figure 19:
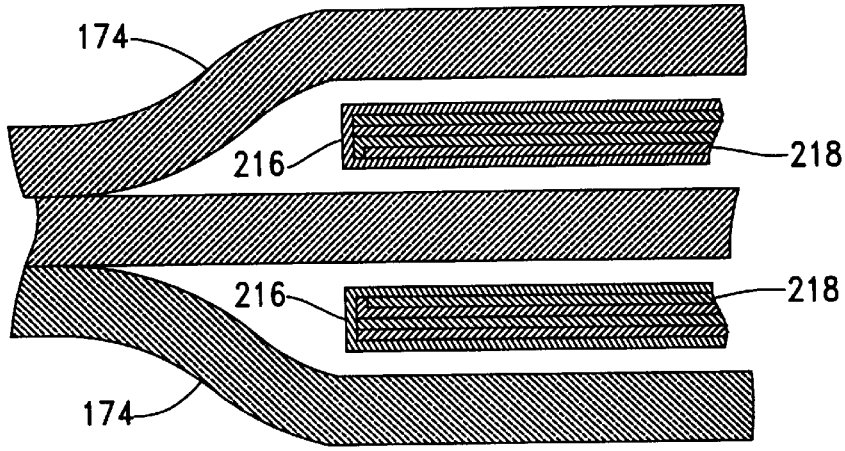
FIG. 19 is a fragmentary cross-sectional view of a pair of electroluminescent panels held in transparent pockets in opposite sides of a kit cover, in the illuminated kite of FIG. 1, to project light in differing images from both sides of the cover.

FIG. 19 is a fragmentary cross-sectional view of a pair of electroluminescent panels 216 provided as separate structures held within a pair of pockets 174 extending along opposite sides of the kite cover 20. These panels 216 are preferably each configured as described in reference to FIG. 16, except that the electrode layers 218 adjacent the kite cover 20 are preferably opaque. In the electroluminescent panels 210, 212, and 216 of FIGS. 17, 18, and 19, the luminescent layers are preferably configured so that the same image is presented from each side of the kite 10, without a mirror-image type of reversal, or so that a different image is presented from each side of the kite 10.

Referring again to FIGS. 1 and 8, an alternating current power supply 220 is preferably included as part of the battery box 26 to provide a means for electrically driving the electroluminescent panels 170, 172. This power supply 220 is connected by a pair of wires 222 to each of the output terminals 74, 76 of the battery box 26 to receive power from the batteries 110 and to be switched on and off, along with the light circuits 22 by means of the switch 112. The power supply 220 is preferably an inverter operating to convert direct current from the batteries 110 into alternating current. The power supply 220 may, for example, either produce power for driving the panels 170, 172 in the conventional manner, at 115 volts and 400 Hz, or at a lower voltage, such as 60–70 volts, and a higher frequency, such as 1.0–1.5 kHz. The output of the power supply 220 is directed along conductive lines 224 printed on a flexible circuit 226 extending through apertures 228 in the kite cover 20 toward the electroluminescent panels 170, 172, which are on an opposite side of the kite cover 20 from the battery box 26.

Figure 20:
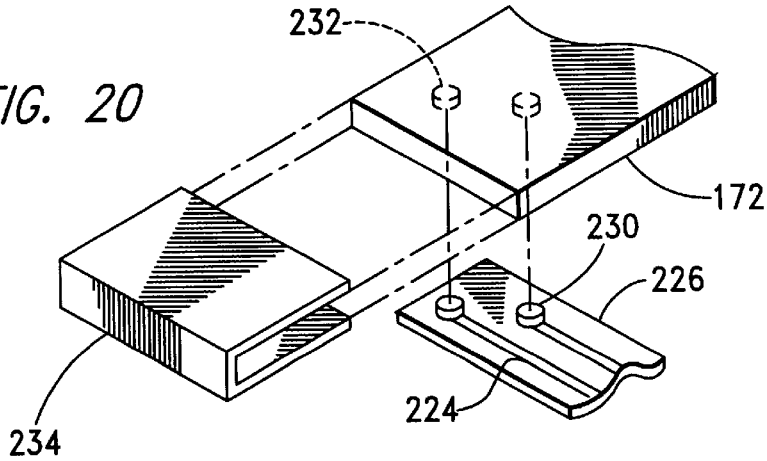
FIG. 20 is a fragmentary exploded isometric view of the attachment of electrical conductors to the electroluminescent panel of FIG. 16.

FIG. 20 is a fragmentary exploded view showing the electrical attachment of a portion of the flexible circuit 226 to the monolithic elastomeric electroluminescent panel 172. Contact pads 230, which may be metallic or silicone rubber with conductive surfaces, are attached to the conductive lines 224 on the flexible circuit 226 by means of a conductive adhesive. These contact pads 230 extend within cavities 230 in the elastomeric electroluminescent panel 172 to make electrical contact with the various electrode layers. The end of the flexible circuit 226 is held in place on the electroluminescent panel 172 by means of plastic clip 234 slid over this assembly.

Figure 21:
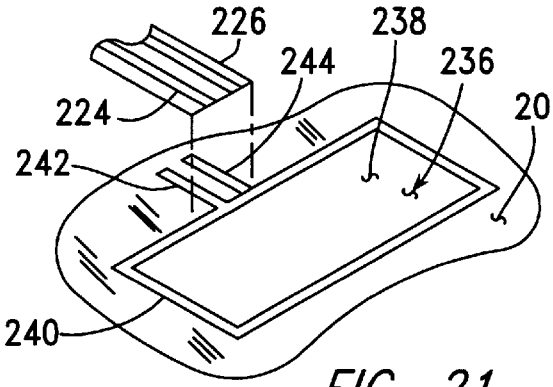
FIG. 21 is a fragmentary exploded isometric view of the attachment of electrical conductors to the electroluminescent panel of FIG. 14.

FIG. 21 is a fragmentary exploded view showing the electrical attachment of a portion of the flexible circuit 226 to an electroluminescent panel 236 coated on the surface of the kite cover 20, in the manner of electroluminescent panel 170 (shown in FIGS. 1 and 2). An outer electrode layer 238 of the electroluminescent panel 236 is surrounded by a coated conductive bus bar 240, which may, for example, include silver, and which includes a termination tab 242. An inner electrode layer (not shown) of the electroluminescent panel 236 is surrounded by a similar coated conductive bus bar, of which only a termination tab 244 is visible. The flexible circuit 226 includes a pair of conductive lines 224, which face downward in the orientation of FIG. 21. These conductive lines 224 are individually attached to the termination tabs 244 by means of a conductive adhesive. The flexible circuit 226 is otherwise attached to the kite cover 20 by means of an adhesive, by sewing, or, assuming compatible materials, by heat sealing.

While the preceding discussion has described conductive lines 224 being carried by a flexible circuit 226 between the power supply 220 and the associated electroluminescent panels 172, 236, it is apparent that conductive lines count alternately be printed on the kite cover 20 to extend between the power supply 220 and the electroluminescent panels 172, 236.

The preceding discussion has particularly described the application of the present invention to a delta kite, having the general shape of an equilateral triangle with a descending keel. Alternately, the present invention may be applied to a number of other kite designs which are flat, bowed, or which have segments extending upward at dihedral angles. Such kite designs differ from the delta kite in the shape of the kite cover and in the arrangement of support members. In the application of the present invention, light circuits by be provided to extend adjacent various of the support members, regardless of their configuration, and electroluminescent panels may be applied to extend along the surface of a kite cover, regardless of its shape. For example, the Eddy kite includes a straight longitudinal support member and a bowed transverse support member. Light circuits may be arranged to extend along these support members to provide a generally cruciform lighting pattern.

Figure 22:
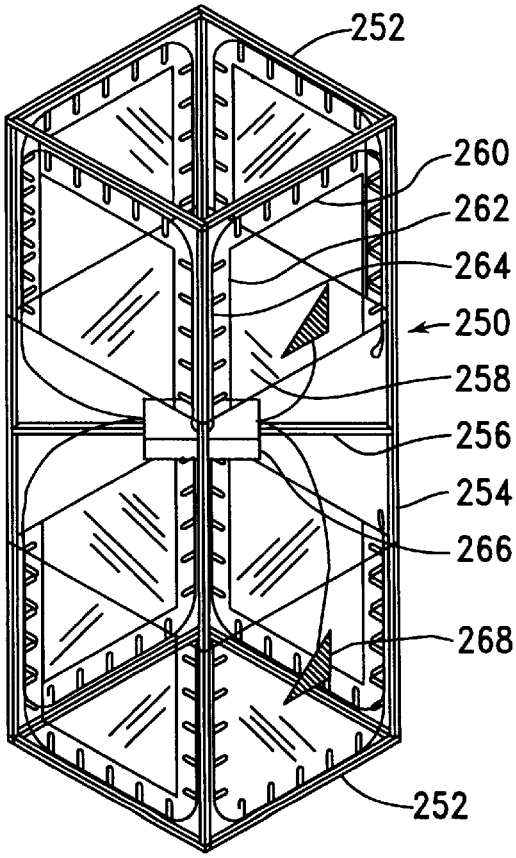
FIG. 22 is an isometric view is an isometric view of an illuminated box kite built in accordance with an alternate embodiment of the present invention.

FIG. 22 is an isometric view of a box kite 250 built in accordance with the present invention. The support structure of this box kite 250 includes a pair of end frames 252 forming square frameworks, four longitudinal support members 254 extending between the end frames 252, and an "X"-shaped central brace 256. At each end of the kite, a single transparent cover sheet 258 extends around the four longitudinal support members 254, with segments being folded around the four sides of the end frame 252 to form sleeves 260 extending along the end frame 252, generally as described above in reference to FIG. 3 or 9. These segments may additionally extend to form sleeves 262 extending adjacent the longitudinal support members 254, with lap joint seams being formed along each side of a light circuit 264. Alternately, the light circuits extending along each side of a longitudinal support member 254 are held in a single transparent sleeve fastened to the cover 258 outside the light circuit 264. A battery box 266, fastened to the central brace 256, supplies electrical power to the light circuit 264. The box kite 250 may also include one or more electroluminescent panels 268, with these panels 268 being illuminated by an alternating current power source within the battery box 266 in the manner described above in reference to FIG. 8.

Figure 23:
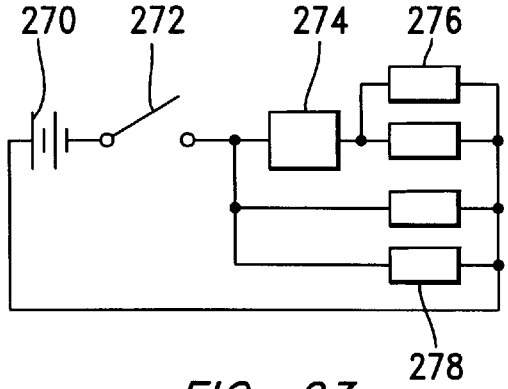
FIG. 23 is a schematic view of a circuit for causing certain light circuits in the illuminated kite of FIG. 1 or of FIG. 22 to flash on and off.

FIG. 23 is a schematic view of a circuit used to cause certain of the lights in the kite of FIG. 1 or of FIG. 22 to flash. A battery 270 is connected through a manually actuated switch 272 to a flasher circuit 274, which is in turn connected to a number of light circuits 276, which then flash on and off with the operation of the flasher circuit 274. Optionally, other light circuits 278 are connected directly to the switch 272, so that they do not flash. The flasher circuit 274 may be an electromechanical device, interrupting the flow of current to the light circuits 276, or a multivibrator.

Figure 24:
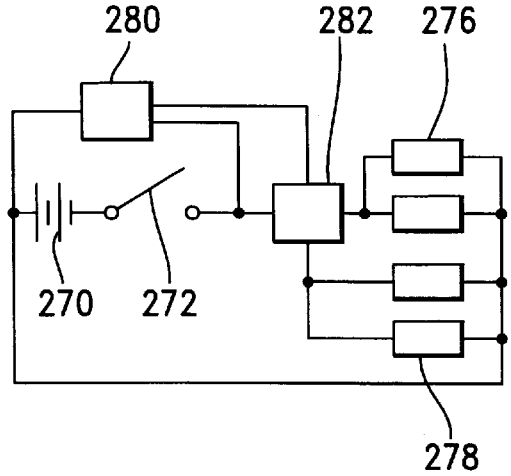
FIG. 24 is a schematic view of a circuit for causing certain light circuits in the illuminated kite of FIG. 1 or of FIG. 22 to flash alternately.

FIG. 24 is a schematic view of a circuit used to cause certain of the lights in the kite of FIG. 1 or of FIG. 22 to flash in a sequentially alternating manner. The battery 270 is connected through the manually actuated switch 272 to a flasher circuit 280, which provides a signal driving a switching circuit 282. The switching circuit 282 directs electrical current from the battery 270 to either light circuits 276 or light circuits 278, according to the output of the flasher circuit 280, which may be an electromechanical device or a multivibrator. The switching circuit 280 may be a relay or a transistor switching circuit.

It is understood that the present invention includes, within its scope, a kite having only one or more electroluminescent light sources extending along its surface(s) to be directly viewed. While the preceding discussion has been particularly directed at a kite in which an individual light source is seen from both sides of a transparent kite sheet, it is understood that a kite having only electroluminescent light sources can be built with an opaque kite cover. While it is desirable to have the lights visible from both sides of the kite, and while the design of a kite to have sleeves formed of the material forming the kite cover into which light circuits are placed indicates that such a kite should have a transparent cover, the present invention is considered to include a kite having an opaque cover with electroluminescent panels attached to the cover, preferably facing in a direction in which they are seen by the person flying the kite. Such panels should include opaque, reflective electrode layers adjacent the kite cover material, in order to produce a brighter light by internal reflection.

While the present invention has been described in its preferred forms or embodiments with some degree of particularity, it is understood that this description has been given only by way of example and that numerous changes in the details of construction, fabrication, and use, including the combination and arrangement of parts, may be made without departing from the spirit and scope of the invention.

What is claimed is:

1. An illuminated kite comprising:

a frame including a plurality of structural members providing structural support;

a transparent cover sheet attached to various structural members within said plurality of structural members, wherein said transparent cover sheet is stretched between various said structural members to provide for aerodynamic flight;

a plurality of light sources extending along said transparent cover sheet, wherein each light source in said plurality thereof is directly visible from each side of said transparent cover sheet;

a battery power source electrically connected to said plurality of light sources, and a first transparent sleeve extending along said transparent cover sheet, wherein said plurality of light sources includes a first light circuit extending within said first transparent sleeve, and wherein said first light circuit includes conductive wires electrically connected to said battery power source and a plurality of light bulbs extending along said conductive wires in a spaced-apart relationship and electrically connected with said conductive wires to illuminate when an electrical potential is placed across said conductive wires.

2. The illuminated kite of claim 1, wherein said first transparent sleeve extends adjacent and parallel a first structural member within said plurality of structural members.

3. The illuminated kite of claim 2, additionally comprising a frame attachment sleeve extending along said transparent cover sheet, wherein said first structural member extends within said frame attachment sleeve.

4. The illuminated kite of claim 1, wherein a first structural member within said plurality of structural members extends within said transparent sleeve.

5. The illuminated kite of claim 1, additionally comprising an interrupter causing certain light bulbs within said plurality of light bulbs to flash.

6. The illuminated kite of claim 1, wherein said plurality of structural members includes first and second edge support members extending from an apex to form sides of a triangular space, a longitudinal support member extending from said apex between said first and second edge support members, and a transverse support member extending across said longitudinal support member between said first and second edge support member, said transparent cover sheet extends across said triangular space between said first and second edge support members, said first light circuit extends adjacent and parallel to said first edge support member, said illuminated kite additionally includes a second transparent sleeve extending along said transparent cover sheet, and a second light circuit extending within said second transparent sleeve, wherein said second light circuit includes conductive wires and a plurality of light bulbs extending along said conductive wires in a spaced-apart relationship and connected with said conductive wires to illuminate when an electrical potential is placed across said conductive wires, and said battery power source electrically is additionally connected across said conductive wires in said second light circuit.

7. The illuminated kite of claim 6, wherein said transparent cover sheet is folded around said first edge support member and said first light circuit to form said first transparent sleeve and around said second edge support member and said second light circuit to form said second transparent sleeve.

8. The illuminated kite of claim 6, wherein said transparent cover sheet is folded around said first edge support member to form a first frame attachment sleeve, around said first light circuit to form said first transparent sleeve, around said second edge support member to form a second frame attachment sleeve, and around said second light circuit to form said second transparent sleeve, said first transparent sleeve is spaced apart from said first frame attachment sleeve, and said second transparent sleeve is spaced apart from said second frame attachment sleeve.

9. The illuminated kite of claim 6, wherein said battery power source is centrally located within said kite, said first light circuit additionally extends toward said apex adjacent said longitudinal support member on a first side of said longitudinal support member from said battery power source, said second light circuit additionally extends toward said apex adjacent said longitudinal support member on a second side of said longitudinal support member from said battery power source, and said second side of said longitudinal support member is opposite said first side of said longitudinal support member.

10. The illuminated kite of claim 9, additionally comprising a third light circuit, extending away from said apex adjacent said longitudinal support member on said first side of said longitudinal support member from said battery power source, wherein said third light circuit is curved to extend toward battery power source adjacent said longitudinal support member on said second side of said longitudinal support member.

11. The illuminated kite of claim 10, additionally comprising a central transparent sleeve extending along said transparent cover sheet, wherein said longitudinal support member, a portion of said first light circuit, and a portion of said second light circuit and portions of said third light circuit extend within said central transparent sleeve.

12. The illuminated kite of claim 10, additionally comprising:

a central frame attachment sleeve, wherein said longitudinal support member extends within said central frame attachment sleeve;

a first central transparent sleeve, extending along said transparent cover sheet and said first side of said central frame attachment sleeve in a spaced apart relationship with said central frame attachment sleeve, wherein a portion of said first light circuit and a portion of said third light circuit extend in said first central transparent sleeve; and a second central transparent sleeve, extending along said transparent cover sheet and said second side of said central frame attachment sleeve in a spaced apart relationship with said central frame attachment sleeve, wherein a portion of said second light circuit and a portion of said third light circuit extend in said second central transparent sleeve.

13. The illuminated kite of claim 10, additionally comprising a fourth light circuit extending adjacent said transverse support member from said battery power source along a first side of said transverse support member, wherein said fourth light circuit is curved to extend past said battery power source along a second side of said transverse support member, opposite said first side of said transverse support member, and wherein said fourth light circuit is also curved to extend toward said battery power source along said first side of said battery power source.

14. The illuminated kite of claim 13, wherein said transverse support member includes a central portion pivotally mounted on said longitudinal support member, extending in a spaced apart relationship with said transparent cover sheet, and end portions extending toward said transparent cover sheet at ends of said central portion to engage said edge support members, said illuminated kite additionally comprises a pair of transparent transverse sleeves extending along opposite sides of said transverse support member between said end portions of said transverse support member and between said transparent cover sheet and said central portion of said transverse support member when said transverse support member is pivoted away from said edge support members, and said fourth light circuit extends within said pair of transparent transverse sleeves.

15. The illuminated kite of claim 13, wherein said transverse support member is pivotally mounted on said longitudinal support member, said illuminated kite additionally comprises a pair of transparent transverse sleeves extending along opposite sides of said transverse support member and along an opposite side of said transparent cover sheet from said transverse support member, and said fourth light circuit extends within said pair of transparent transverse sleeves.

16. The illuminated kite of claim 1, additionally comprising:

an electroluminescent panel extending along a first side of said transparent cover sheet, and an alternating current power source with first and second output terminals electrically driving said electroluminescent panel.

17. The illuminated kite of claim 16, wherein said electroluminescent panel is formed as a plurality of coated layers extending along said transparent cover sheet.

18. The illuminated kite of claim 17, wherein said plurality of layers includes a first translucent electrode layer, electrically connected to said first output terminal of said alternating current power source, coated adjacent a first side of said transparent cover sheet;

a second translucent electrode layer, electrically connected to said second output terminal of said alternating current power source; and a luminescent layer and a dielectric layer, each coated to extend together between said first and second translucent electrode layers.

19. The illuminated kite of claim 16, wherein said illuminated kite additionally comprises a first transparent pocket extending along said transparent cover sheet, and said electroluminescent panel is formed as a discrete elastomeric structure extending within said first transparent pocket.

20. The illuminated kite of claim 19, wherein said discrete elastomeric structure includes:

a first translucent electrode layer, electrically connected to said first output terminal of said alternating current power source, coated to extend along a first side of said discrete elastomeric structure;

a second translucent electrode layer, electrically connected to said second output terminal of said alternating current power source, coated to extend along a side of said discrete elastomeric structure opposite said first side of said discrete elastomeric structure;

a luminescent layer and a dielectric layer, each coated to extend together between said first and second translucent electrode layers.

21. An illuminated kite comprising:

a frame including a plurality of structural members providing structural support;

a transparent cover sheet attached to various structural members within said plurality of structural members, wherein said transparent cover sheet is stretched between various said structural members to provide for aerodynamic flight;

a plurality of light sources extending along said transparent cover sheet, wherein each light source in said plurality thereof is directly visible from each side of said transparent cover sheet, an electroluminescent panel extending along a first side of said transparent cover sheet, wherein said electroluminescent panel is formed as a plurality of coated layers extending along said transparent cover sheet said plurality of layers includes a first translucent electrode layer, electrically connected to said first output terminal of said alternating current power source, coated adjacent a first side of said transparent cover sheet; a second translucent electrode layer, electrically connected to said second output terminal of said alternating current power source; and a luminescent layer and a dielectric layer, each coated to extend together between said first and second translucent layers;

a battery power source electrically connected to said plurality of light sources; and an alternating current power source with first and second output terminals electrically driving said electroluminescent panel.

22. An illuminated kite comprising:

a frame including a plurality of structural members providing structural support;

a transparent cover sheet attached to various structural members within said plurality of structural members, wherein said transparent cover sheet is stretched between various said structural members to provide for aerodynamic flight;

a first transparent pocket extending along said transparent cover sheet a plurality of light sources extending along said transparent cover sheet, wherein each light source in said plurality thereof is directly visible from each side of said transparent cover sheet;

an electroluminescent panel extending along a first side of said transparent cover sheet, wherein said electroluminescent panel is formed as a discrete elastomeric structure extending within said first transparent pocket;

a battery power source electrically connected to said plurality of light sources; and an alternating current power source with first and second output terminals electrically driving said electroluminescent panel.

23. The illuminated kite of claim 22, wherein said discrete elastomeric structure includes:

a first translucent electrode layer, electrically connected to said first output terminal of said alternating current power source, coated adjacent a first side of said transparent cover sheet;

a second translucent electrode layer, electrically connected to said second output terminal of said alternating current power source, coated adjacent a second side of said transparent cover sheet, opposite said first side of said transparent cover sheet;

a luminescent layer and a dielectric layer, each coated to extend together between said first and second translucent electrode layers.

24. An illuminated kite comprising:

a frame including a plurality of structural members providing structural support;

a cover sheet attached to various structural members within said plurality of structural members, wherein said transparent cover sheet is stretched between various said structural members to provide for aerodynamic flight;

a plurality of light circuits extending along various of said structural members within said plurality of structural members, wherein each light circuit within said plurality of light circuits includes conductive wires and a plurality of light bulbs extending along said conductive wires in a spaced-apart relationship and connected with said conductive wires to illuminate when an electrical potential is placed across said conductive wires;

a plurality of transparent sleeves extending adjacent various of said structural members within said plurality of structural members, wherein light circuits within said plurality of light circuits extend within transparent sleeves within said plurality of transparent sleeves; and a battery power source electrically connected across said conductive wires in said first light circuit.

25. An illuminated kite comprising:

a frame including a plurality of structural members providing structural support;

a cover sheet attached to various structural members within said plurality of structural members, wherein said transparent cover sheet is stretched between various said structural members to provide for aerodynamic flight;

a plurality of light circuits extending along various of said structural members within said plurality of structural members, wherein each light circuit within said plurality of light circuits includes conductive wires and a plurality of light bulbs extending along said conductive wires in a spaced-apart relationship and connected with said conductive wires to illuminate when an electrical potential is placed across said conductive wires;

a plurality of transparent sleeves, wherein light circuits within said plurality of light circuits and structural members within said plurality of structural members extend together within said plurality of transparent sleeves; and a battery power source electrically connected across said conductive wires in said first light circuit.

26. An illuminated kite comprising:

a frame including a plurality of structural members providing structural support;

a cover sheet attached to various structural members in said plurality of structural members, wherein said cover sheet is stretched between various said structural members to provide for aerodynamic flight;

an electroluminescent panel extending along a first side of said cover sheet, wherein said electroluminescent panel is formed as a plurality of coated layers extending along said cover sheet and wherein said plurality of layers includes a first electrode layer, electrically connected to said first output terminal of said alternating current power source, coated adjacent a first side of said cover sheet, a second electrode layer, electrically connected to said second output terminal of said alternating current power source, coated on said dielectric layer, wherein said second electrode layer is translucent, and a dielectric layer and a luminescent layer coated to extend together between said first and second electrode layers; and an alternating current power source with first and second output terminals electrically driving said electroluminescent panel.

27. The illuminated kite of claim 26, wherein said cover sheet is transparent, and said first electrode layer is translucent.

28. An illuminated kite comprising:

a frame including a plurality of structural members providing structural support;

a cover sheet attached to various structural members in said plurality of structural members, wherein said cover sheet is stretched between various said structural members to provide for aerodynamic flight, wherein said cover sheet is transparent;

an electroluminescent panel extending along a first side of said cover sheet, wherein said electroluminescent panel is formed as a plurality of coated layers extending along said cover sheet, wherein said plurality of layers includes a first translucent electrode layer, electrically connected to said first output terminal of said alternating current power source, coated adjacent a first side of said cover sheet, a second translucent electrode layer, electrically connected to said first output terminal of said alternating current power source, coated adjacent a second side of said cover sheet, opposite said first side of said cover sheet, an intermediate electrode layer, electrically connected to said second output terminal of said alternating current power source, a first dielectric layer and a first luminescent layer coated to extend together between said first translucent electrode and said intermediate layer, and a second dielectric layer and a second luminescent layer coated to extend together between said second translucent electrode and said intermediate layer; and an alternating current power source with first and second output terminals electrically driving said electroluminescent panel.

29. An illuminated kite comprising:

a frame including a plurality of structural members providing structural support;

a cover sheet attached to various structural members in said plurality of structural members, wherein said cover sheet is stretched between various said structural members to provide for aerodynamic flight;

a first transparent pocket extending along said cover sheet;

an electroluminescent panel extending along a first side of said cover sheet, wherein said electroluminescent panel is formed as a discrete elastomeric structure extending within said first transparent pocket; and an alternating current power source with first and second output terminals electrically driving said electroluminescent panel.

30. The illuminated kite of claim 29 wherein said discrete elastomeric structure includes:

a first electrode layer, electrically connected to said first output terminal of said alternating current power source, coated adjacent a first side of said cover sheet;

a second electrode layer, electrically connected to said second output terminal of said alternating current power source, wherein said second electrode layer is translucent; and a dielectric layer and a luminescent layer coated to extend together between said first and second electrode layers.

31. The illuminated kite of claim 30, wherein said cover sheet is transparent, and said first electrode layer is translucent.

32. The illuminated kite of claim 29, wherein said cover sheet is transparent, and said plurality of layers includes a first translucent electrode layer, electrically connected to said first output terminal of said alternating current power source, coated adjacent a first side of said cover sheet, a second translucent electrode layer, electrically connected to said first output terminal of said alternating current power source, coated adjacent a second side of said cover sheet, opposite said first side of said cover sheet, an intermediate electrode layer, electrically connected to said second output terminal of said alternating current power source, a first dielectric layer and a first luminescent layer coated to extend together between said first translucent electrode and said intermediate layer, and a second dielectric layer and a second luminescent layer coated to extend together between said second translucent electrode and said intermediate layer.

* * * * *